US006604974B2

(12) United States Patent
Doty et al.

(10) Patent No.: US 6,604,974 B2
(45) Date of Patent: Aug. 12, 2003

(54) METHOD AND APPARATUS FOR APPLYING CROSSWIRES TO A TENSION FOCUS MASK

(75) Inventors: James Edward Doty, Skillman, NJ (US); Edward Richard Garrity, Jr., Lancaster, PA (US); Mark Allen Thomson, Lancaster, PA (US); Leonard Pratt Wilbur, Jr., Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 382 days.

(21) Appl. No.: 09/747,231

(22) Filed: Dec. 22, 2000

(65) Prior Publication Data

US 2002/0102901 A1 Aug. 1, 2002

(51) Int. Cl.[7] ..... H01J 9/236; H01J 9/12; H01J 9/06

(52) U.S. Cl. ..... 445/37; 445/36; 445/47; 445/67; 445/68; 242/166; 242/439.5

(58) Field of Search ..... 445/37, 36, 67, 445/68, 47, 35, 30, 60; 242/166, 439.5, 597.7, 437.4; 29/428, 452; 313/402–404, 407

(56) References Cited

U.S. PATENT DOCUMENTS 5,613,889 A * 3/1997 Nosker et al. ..... 445/37
6,247,987 B1 * 6/2001 Moore ..... 445/24
6,501,213 B2 * 12/2002 Doty ..... 313/402

FOREIGN PATENT DOCUMENTS

JP 05342985 A * 12/1993 ..... H01J/9/14

* cited by examiner

*Primary Examiner*—Kenneth J. Ramsey
*Assistant Examiner*—German Colón
(74) *Attorney, Agent, or Firm*—Joseph S. Tripoli; Joseph J. Laks; Carlos M. Herrera

(57) ABSTRACT

A method and apparatus for applying crosswires to a tension mask. The method includes winding crosswires around various drum assemblies and then using transfer devices to remove sections of crosswires and transfer them to tension mask frame assemblies.

12 Claims, 8 Drawing Sheets

METHOD AND APPARATUS FOR APPLYING CROSSWIRES TO A TENSION FOCUS MASK

This invention generally relates to color picture tubes and, more particularly, a method and apparatus for transferring and applying crosswires from a drum unit assembly to a tension mask assembly.

BACKGROUND OF THE INVENTION

A color picture tube includes an electron gun for forming and directing three electron beams to a screen of the tube. The screen is located on the inner surface of the face plate of the tube and is made up of an array of elements of three different color emitting phosphors. A color selection electrode, also referred to as a shadow mask, is interposed between the gun and the screen to permit each electron beam to strike only the phosphor elements associated with that beam. A shadow mask is a thin sheet of metal, such as steel, that is contoured to somewhat parallel the inner surface of the tube face plate. A tension mask can be a strand tension mask, tie-bar tension mask or tension focus mask. A tension focus mask comprises two sets of conductive lines that are perpendicular to each other and separated by an insulator. Different voltages are applied to the two sets of lines to create focusing lenses in each of the mask openings. Generally, in a tension focus mask, a vertical set of conductive lines or strands is under tension and a horizontal set of conductive lines or wires overlies the strands.

In assembling a tension focus mask, it is required to assemble the wires and strands with a high degree of accuracy to achieve consistent spacing between the strands and between the wires to optimize visual performance. It is, therefore, desirable to develop techniques for assembling tension focus masks that will provide precise spacing between the vertical conductive elements and between the horizontal conductive element.

SUMMARY OF THE INVENTION

The present invention provides a method and apparatus for transferring and attaching crosswires from a drum assembly to a mask frame assembly. The method includes providing a plurality of crosswires that have been rolled onto a drum assembly. The crosswires are then transferred from the drum assembly to a mask frame assembly. In one embodiment, the crosswires are transferred directly onto a mask frame assembly from a drum assembly. In other embodiments, a transfer apparatus is used to transfer the crosswires from the drum assembly to the mask frame assembly.

In the first embodiment, a drum assembly that has had crosswires rolled onto it, unrolls the crosswires onto a mask frame assembly. In this method, both the mask frame assembly and the drum assembly are rotating about a separate different axis point and are moving in a reciprocating manner as the crosswires are transferred from the drum to the mask frame. In a second embodiment, crosswires that have been wound around a drum assembly are cut by a transfer device and moved from the drum assembly onto the mask frame assembly. In a third embodiment, crosswires wound around a drum are transferred from the drum to the mask frame assembly by a mask frame transfer device that contains a self-tensioning device that allows the crosswires to be straightened and tensioned as they are cut from the drum assembly and transferred to a mask frame assembly.

DETAILED DESCRIPTION

Figure 1:
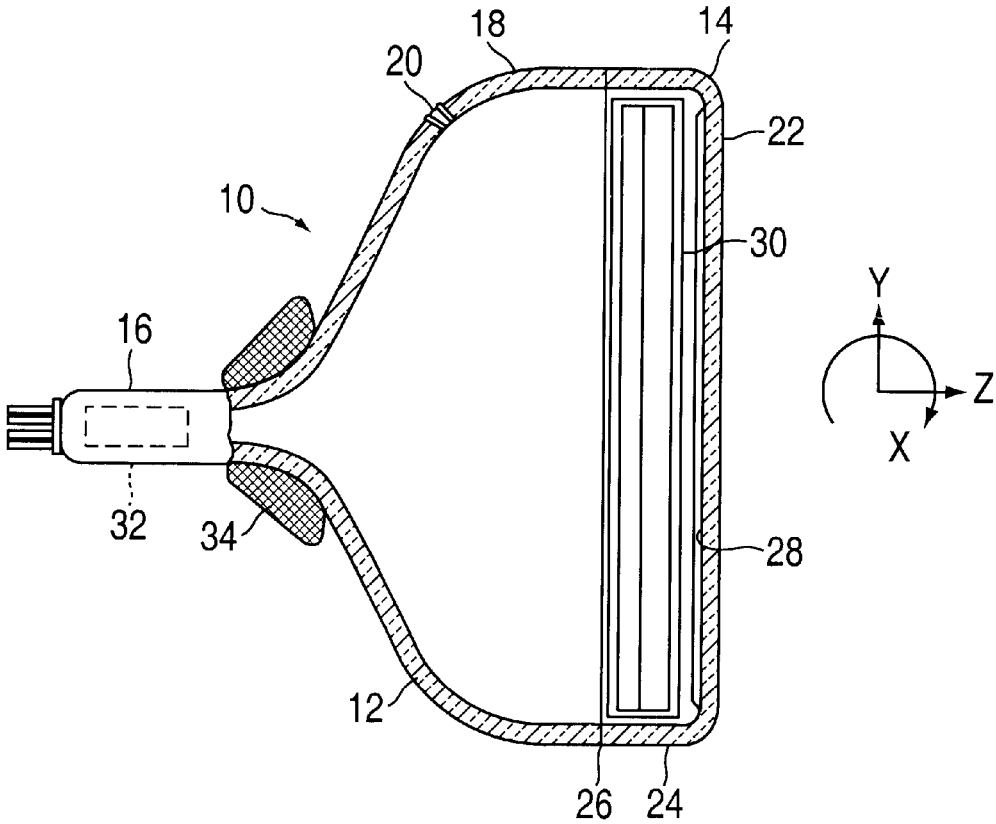
FIG. 1 is a side view, partially in axial section, of a color picture tube, including a tension focus mask-frame-assembly mask according to the present invention.

FIG. 1 shows a cathode ray tube 10 having a glass envelope 12 comprises a rectangular face plate panel 14 and a tubular neck 16 connected by a rectangular funnel 18. The funnel 18 has an internal conductive coating (not shown) that extends from an anode button 20 to a neck 16. The panel 14 comprises a viewing face plate 22 and a peripheral flange or sidewall 24 that is sealed to the funnel 18 by a glass sealing frit 26. A three-color phosphor screen 28 is carried by the inner surface of the face plate 22. The screen 28 is a line screen with the phosphor lines arranged in triads, each triad including a phosphor line of each of the three colors. A tension focus mask 30 is removably mounted in a predetermined spaced relation to the screen 28. Tension focus mask 30 has a differential voltage coupled across the strands and wires. An electron gun 32 (schematically shown by the dashed lines in FIG. 1) is centrally mounted within the neck 16 to generate three in-line electron beams, a center beam and two side beams, along convergent paths through the mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2:
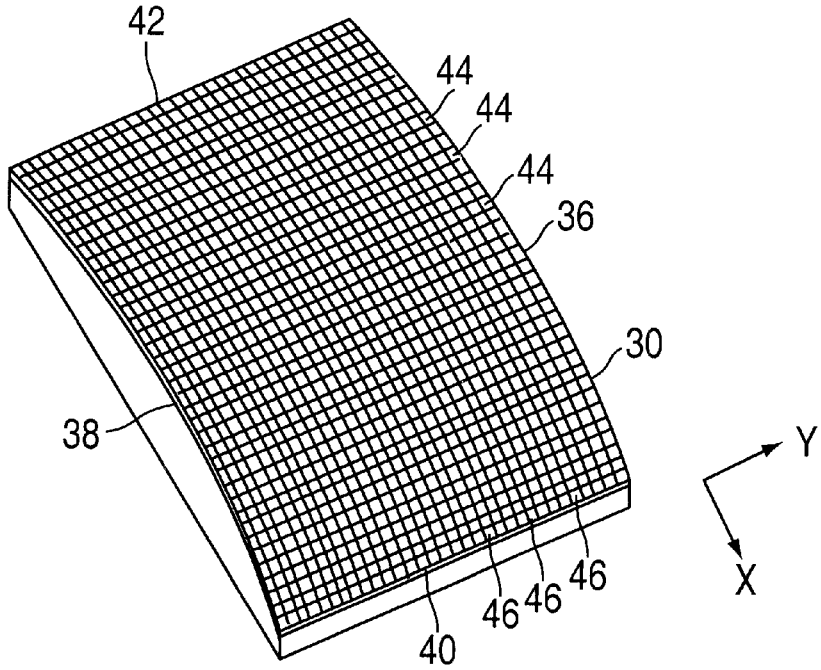
FIG. 2 is a perspective view of the tension focus mask-frame-assembly of FIG. 1.

The tension focus mask 30, shown in greater detail in FIG. 2, includes two long sides 36 and 38 and two short sides 40 and 42. The two long sides 36 and 38 of the mask parallel a central major axis, x, of the tube. The tension focus mask 30 includes two sets of conductive lines: strands 44 that are parallel to the central minor axis y and to each other; and wires 46, that are parallel to the central major axis x and to each other. In one embodiment, the strands 44 are flat strips that extend vertically, having a width of about 0.005 to 0.020" and a thickness of 0.001 to 0.008", and the crosswires 46 have a round cross section, having a diameter of 0.0005 to 0.003" and extend horizontally. In the completed mask, the strands and wires are separated from each other by suitable insulator such as lead-based frit.

FIGS. 3A through 3E depict various views of the system 300 of one embodiment of the invention. This system 300 comprises a drum unit 301 in concert with the mask frame assembly 304. The drum unit 301 consists of a drum 302, crosswires 46 and transfer bars 306.

The transfer bars 306 are temporarily affixed in a vertical orientation parallel to the axis of the drum unit 301 and perpendicular to the crosswires 46. The crosswires 46 are wound around the drum unit 301 over the transfer bars 306 in sections long enough to complete one tension focus mask 30. The circumference of the drum unit 301 may be a multiple of the length of a mask frame assembly 304 thereby facilitating the creation of a plurality of tension focus masks 30 for each revolution of the drum unit 301. After winding the crosswires 46 around the drum unit 301 and over the transfer bars 306, the crosswires 46 are glued to the transfer bars 306 at the point of contact.

The transfer process begins with a transfer bar 306 being attached to the mask frame assembly 304. A transfer bar 306 is affixed to a portion of the mask frame assembly 304 at a point before the mask frame element 314 begins. The crosswires 46 are then transferred to the mask frame assembly 304 and a second transfer bar 306 is affixed to a portion of the mask frame assembly 304 at a point after the mask frame element 314 ends. An adhesive is then applied to crosswires 46 at a point where the crosswires 46 go over the bus bars 312A and 312B and the adhesive is allowed to cure. After curing, the crosswires 46 are cut from the transfer bars 306 and the mask frame element 314 is removed from the mask frame assembly 304.

The mask frame assembly 304 is comprised of a mask frame fixture 316, and a mask frame element 314. The mask frame element 314 is attached to the mask frame fixture 316. The mask frame element 314 further comprises a set of mask strands 44 that have been welded to the mask frame element 314 and a rotating and reciprocating axle 308 that is affixed to the mask frame assembly 304. Before the process of positioning the crosswires 46 onto the mask frame assembly 304 begins, an insulator has been applied to the mask strands 44.

Figure 3B:
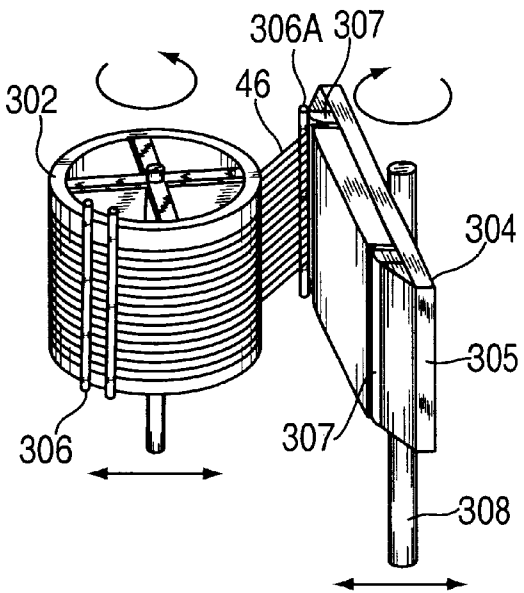
FIGS. 3A, 3B and 3C are three perspective views of the apparatus of a first embodiment of the invention.
Figure 3A:
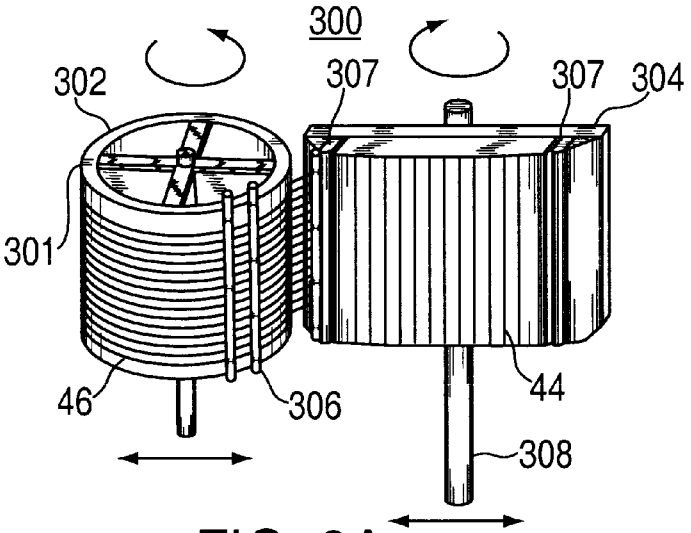

FIG. 3A depicts the crosswires 46 being attached to the mask frame assembly 304. As can be seen in FIG. 3B, the mask frame 304 begins to rotate in a clockwise fashion about the axle 308 that is affixed to the back 303 portion of the mask frame assembly 304. As the mask frame assembly 304 rotates clockwise, drum unit 302 rotates counter 30 clockwise unrolling and seating transfer bar 306A against the mask frame assembly 304. The transfer bar 306 is attached to the mask frame assembly 304 by an appropriate means. This may include but is not limited to gluing, welding or clamping.

Both mask frame 304 and drum assembly 302 move back and forth in a horizontal plane. This back and forth motion allows a specific amount of tension to be applied while maintaining a minimum gap between the drum assembly 302 and the mask frame 304, and thus insuring uniform spacing between the crosswires 46.

Figure 3C:
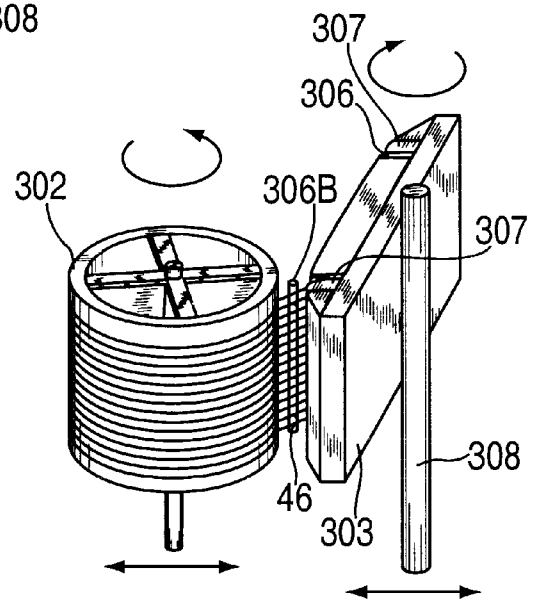

FIG. 3C depicts the second transfer bar 306B being attached to the mask frame 304. The drum 302 has moved back toward the mask frame 304 and the mask frame 304 toward the drum 302 maintaining the smallest gap possible between the drum 302 and the mask frame 304. The transfer portion of the process ends as the transfer bar 6B reaches the opposite side of the mask frame assembly 304 and is affixed in place.

Figure 3E:
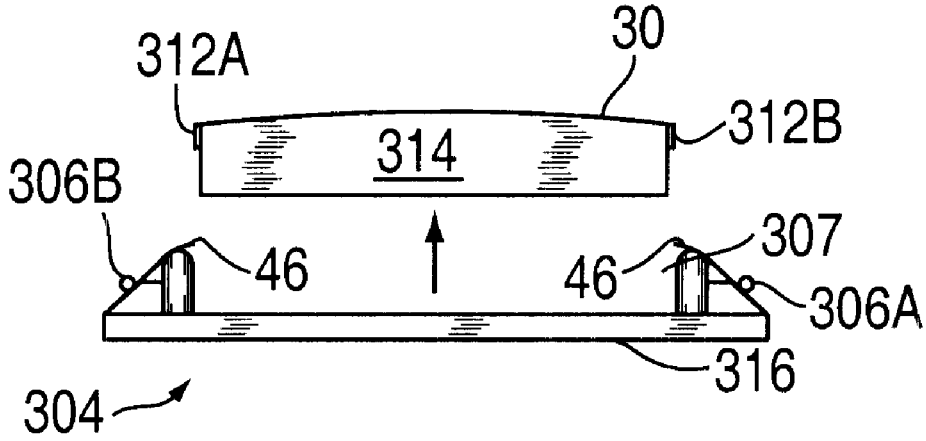
FIGS. 3D and 3E are two side views of the apparatus of a first embodiment of the invention.
Figure 3D:
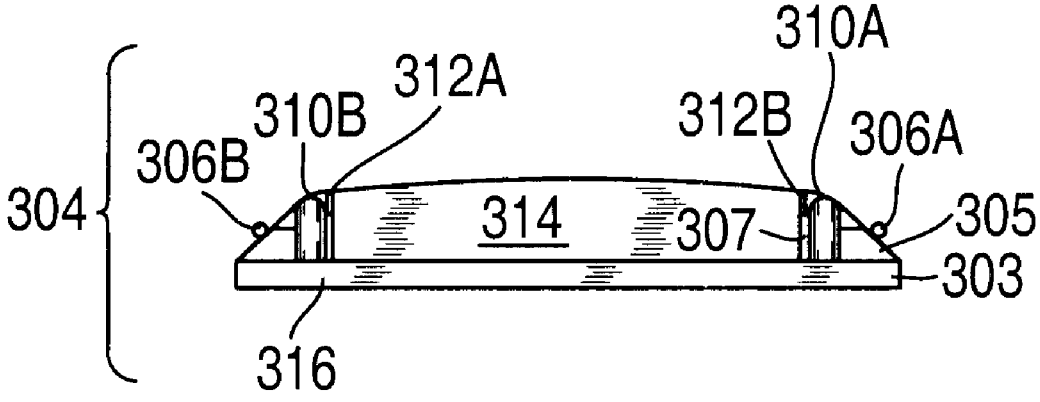

FIG. 3D depicts a side view of the mask frame assembly 304. In this view, the transfer bars 306A and 306B along with the crosswires 46 have been transferred to the mask frame assembly 304. Clearly shown in this figure are the busbars 312A and 312B that are affixed to the mask frame element 314. The bus bars 312A and 312B are glued to the crosswires 46. After the glue has cured, the crosswires 46 are cut at points between transfer bars 306A and 306B and bus bars 312A and 312B.

FIG. 3E depicts a side view of the mask frame assembly 304 showing the mask frame element 314 being detached from the mask frame fixture 316. Clearly shown are crosswires 46 cut from the busbars 312A and 312B and mask frame element 314 being removed from the mask frame fixture 316.

Figure 4A:
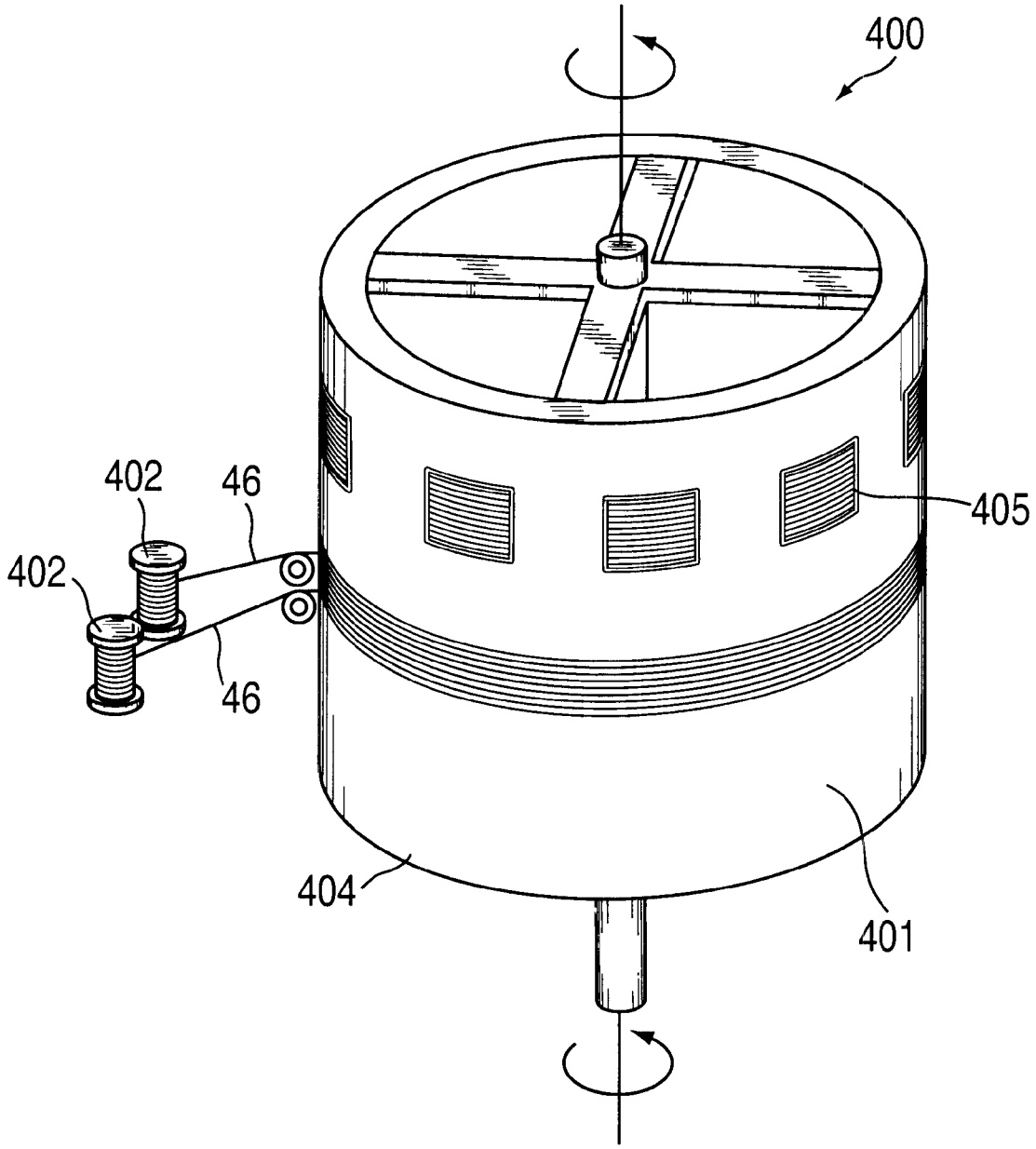
FIGS. 4A, 4B and 4C are a perspective view of the apparatus of an alternative embodiment.
Figure 4B:
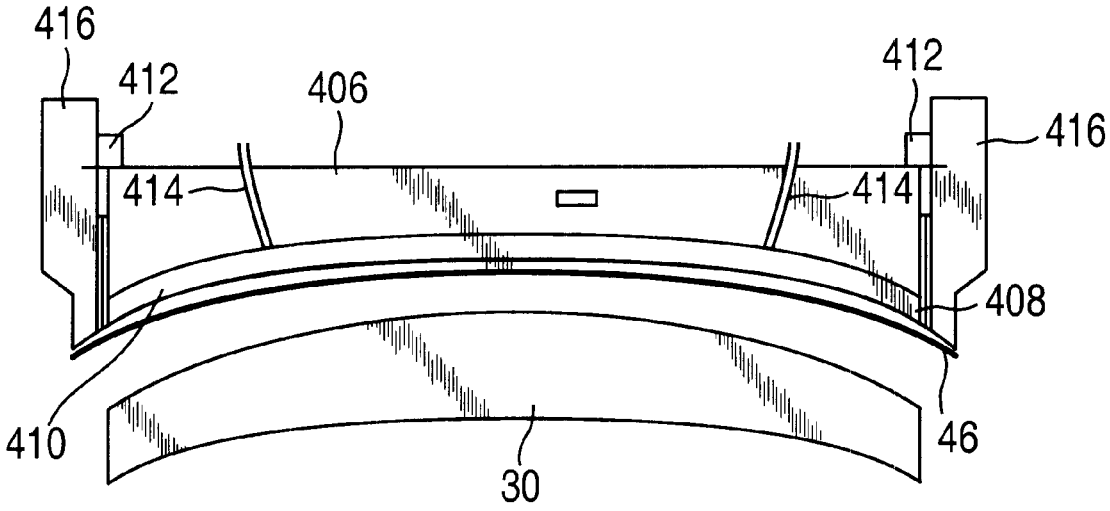
Figure 4C:
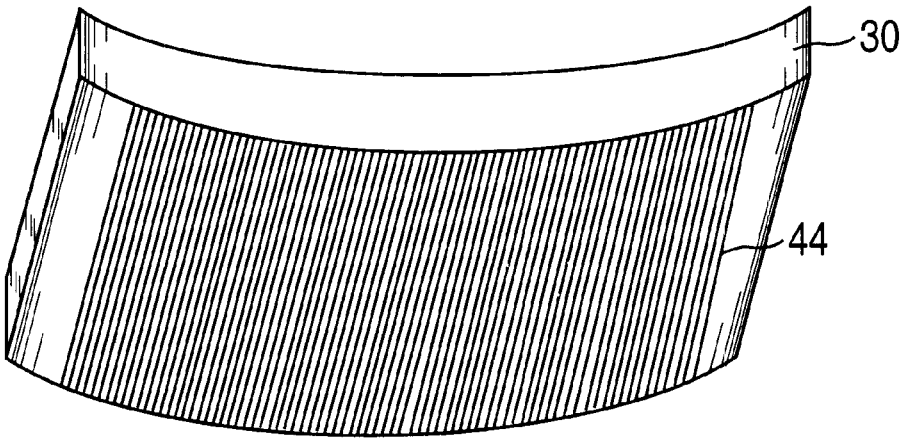

FIGS. 4A, 4B and 4C are a perspective view of the apparatus 400 of an alternative embodiment 400 of the invention. FIGS. 4A–4C show an apparatus comprising three components. The first is the drum unit 400 shown in FIG. 4A, the second shown in 4B is a transfer device 406, as seen from the top with a mask frame 30 and a set of crosswires 46 sandwiched between, and the third seen in perspective, shown in FIG. 4C is a mask frame assembly 30. In this embodiment, wire spools 402 wind crosswires 46 around a large rotating drum assembly 404 before being transferred by a second apparatus 406 to a mask frame assembly shown in FIG. 4B. The wire spools 402 are positioned very close to the drum assembly 404. A low tension force is maintained in the crosswires 46 that helps to provide uniformity of spacing between the crosswires 46.

The second apparatus 400 of this embodiment as depicted in FIG. 4B, is a transfer device 406. The transfer device 406 comprises an electromagnetic holder 408, a contoured attachment point 410, a cutter 412, a vacuum conformer 414, and an automatic busbar attacher 416. The transfer device 406 is formed to match the contour of the surface 401 of the drum assembly 404. The transfer device 406 is large enough to cover a portion of crosswires 405 as depicted in FIG. 4A that will be used to create a single tension mask. This portion of crosswires 405 is shown without the transfer device 406 for clarity.

In practice, transfer device 406 is applied to the outer surface 401 of the drum 404. The transfer device 406 is pressed against the outside surface 401 of the drum 404 and an electromagnetic device 408 activated. As the electromagnetic device 408 becomes active, the crosswires 46 and transfer bars 306A and 306B become fixed relative to themselves and the device 408. The drum 404 may be formed of any non-magnetic material so as not to interfere with the operation of the transfer device. After the crosswires 46 have been fixed magnetically relative to themselves and the electromagnetic device 408, a cutter 412 is activated to cut the crosswires 46 on the drum 404. After cutting the crosswires 46, the transfer device 406 is removed from the drum 404 and placed onto a mask frame 30 as seen in FIG. 4B where the crosswires 46 are affixed onto the mask frame 30. Before the crosswires 46 are applied to the mask strands 44, an insulator is applied to the mask strands 44.

FIG. 4C depicts a perspective view of a mask frame 30 with strands 44 welded in place before crosswires 46 are attached. Crosswires 46 are attached perpendicular to the strands 44 on the mask frame 30. Before contact is made with the mask frame 30 by the crosswires 46, an adhesive is applied to the mask strands 44 of the mask frame 30. The electromagnetic transfer device 408 is applied directly to the mask frame 30 and the crosswires 46 are allowed to bond with the mask strands 44 before the electromagnetic transfer device 408 is deactivated and removed.

Figure 5A:
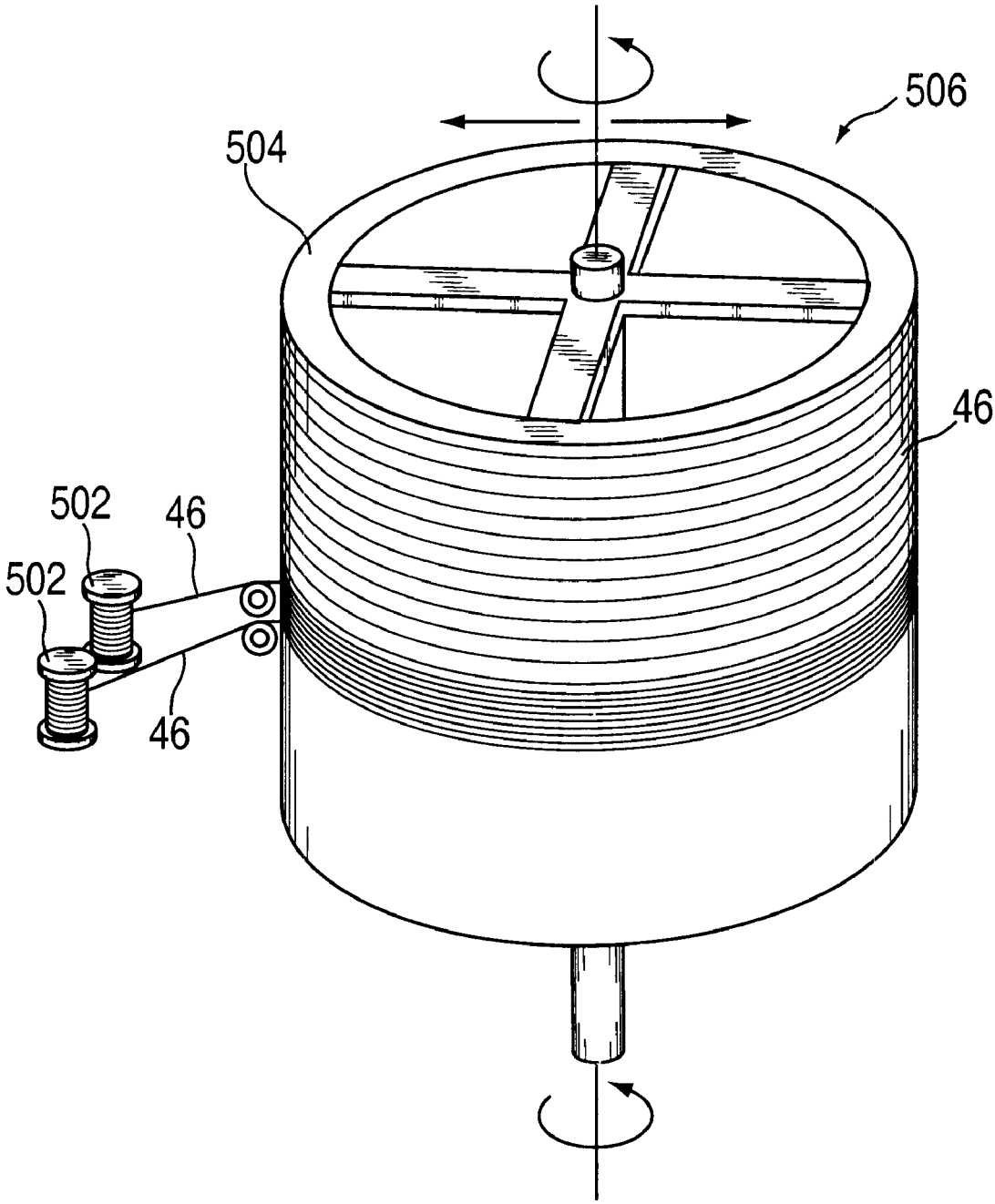
FIGS. 5A, 5B, 5C, 5D and 5E are a perspective view of the apparatus of another alternative embodiment.

FIG. 5A is a perspective view of the apparatus of another alternative embodiment. In this embodiment, multiple wire spools 502 wind crosswires 46 around a drum assembly 504 before being transferred by a second apparatus, as seen in FIGS. 5B–5E, to a mask frame assembly. The drum assembly 504 is preferably fabricated such that its diameter is between 8 and 10 feet. The drum assembly 504 is equipped with a system for uniformly spacing the crosswires 46 as they are wound around the drum.

Figure 5B:
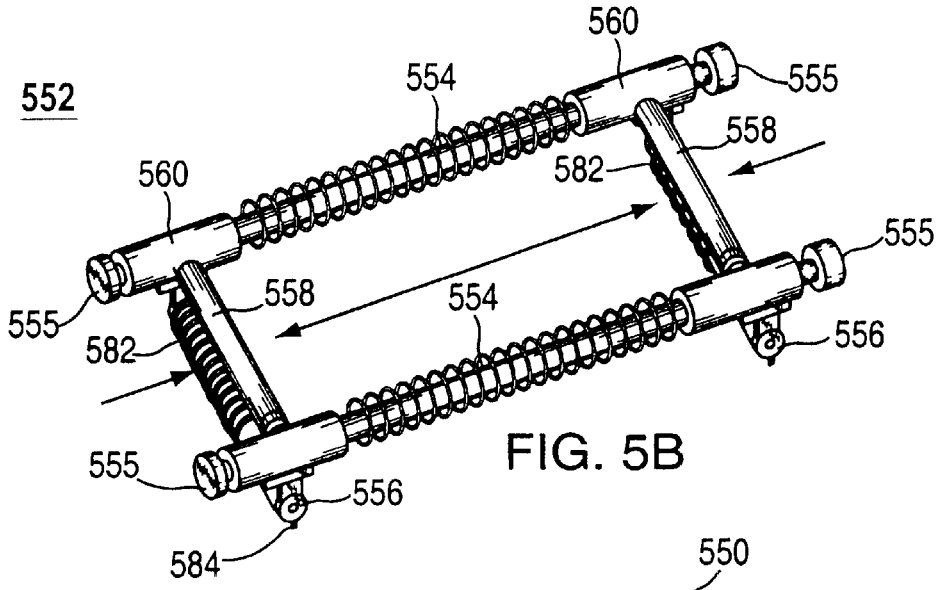
Figure 5C:
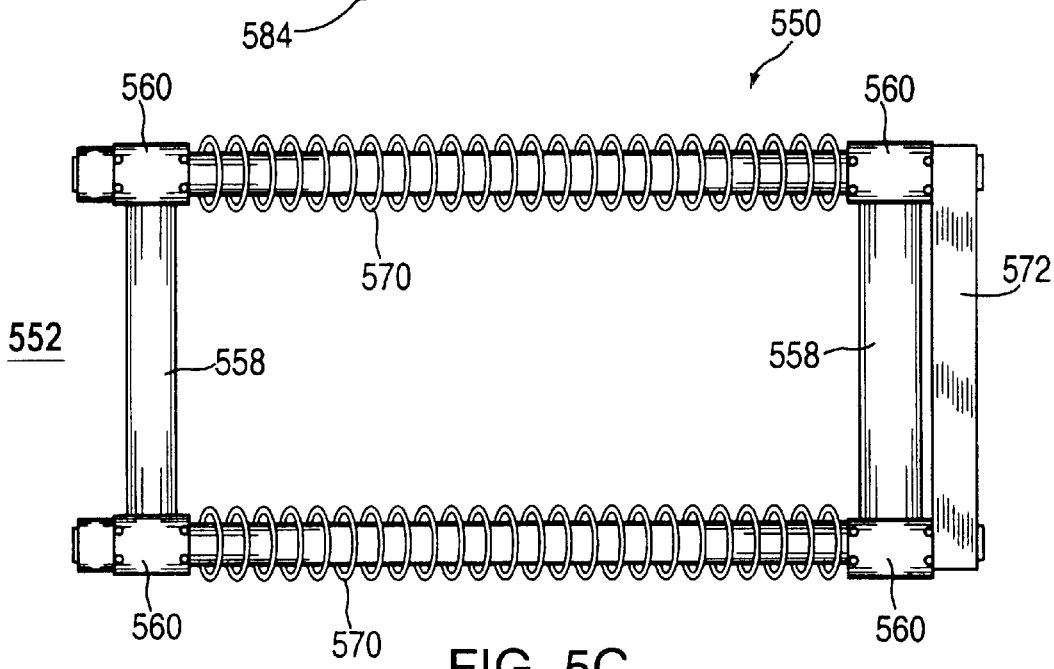
Figure 5D:
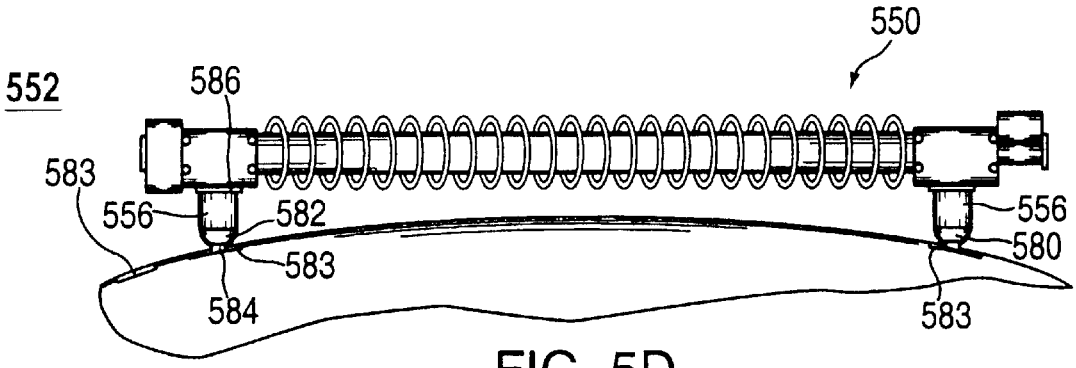
Figure 5E:
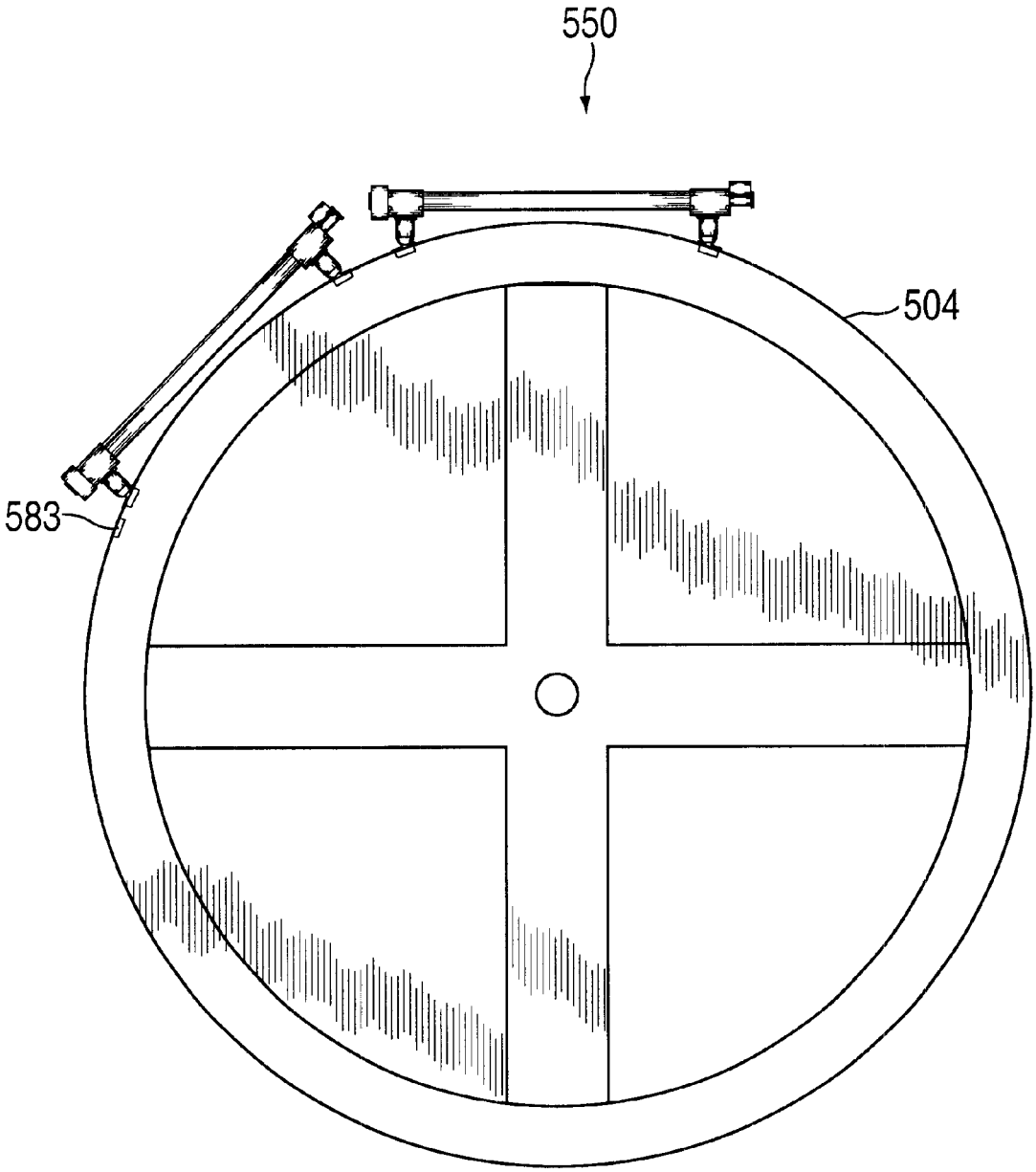

FIGS. 5B, 5C and 5D are perspective views of the second part of the invention is the wire transfer mechanism 550. The wire transfer mechanism 550 is used to transfer the wound crosswires 46 from the drum assembly 504 to a mask frame (as shown in the previous embodiment). The wire transfer mechanism 550 is comprised of a frame 552 which is formed by two segments 554 having two respective ends and being parallel to each other in a substantially horizontal plane connected by a set of sliding vacuum chuck assemblies 556. The vacuum chuck assemblies 556 are kept in tension by a pair of expansion springs 570 disposed around the frame segments 554 and between each of the sliding chuck assemblies 556.

Each sliding vacuum chuck assembly 556 consists of a crossbar 558 having two respective ends. On each of the respective ends of the crossbar 558 is affixed perpendicularly, and on each end, a section of hollow tubing 560 whose diameter is larger than that of the frame segments 552. Both sections of hollow tubing 560 are substantially parallel to each other and perpendicular to the crossbar 558.

The sliding vacuum chuck assembly 556 further comprises a pivoting vacuum chuck assembly 580 that is disposed across the bottom portion of the crossbar 558. The pivoting vacuum chuck assembly 580 includes a vacuum chuck 582, a set of clamps 584 and a leaf spring assembly 586 that is disposed between the vacuum chuck 582 and the crossbar 558. The pivoting vacuum chuck assembly 580 is specifically designed to be clamped onto the drum assembly 504 and to grab onto and hold the crosswires 46. A set of clamps 584 disposed on the transfer mechanism 550 lock into small recesses 583 on the drum 504. The recesses 583 allow the clamps 584 to mate and lock securely into place.

The wire transfer mechanism 550 is assembled by placing two frame segments 554 through each end of the hollow tubing 560 that is attached to the crossbar 558. After the frame bars are placed through the hollow tubing 560, they are slidably moved down to their respective ends that contain a stop 555. The stop 555 is a removable obstruction that prevents hollow tubing 560 from falling off the ends of the frame segment 554. Expansion springs 570 are now placed over frame bars 554 until they are stopped by the structure of the hollow tubing 560. A second sliding chuck assembly 556 is now slid in place over the two frame segment 554 by inserting the frame segment 554 into the apertures of the hollow tubing 560. Once in place, sliding chuck assembly 556 is retained on frame segment 554 by a removably affixed stop 555. At this point, the expansion springs 570 are under little, if any, compression.

In practice, after crosswires 46 are wound around drum 504, wire transfer mechanism 550 may now be applied. First, wire transfer mechanism 550 is placed under compression by moving the sliding chuck assemblies 556 toward each other. As sliding chuck assemblies 556 are moved toward each other, a set of spacers 572 are employed to hold the compressed sliding chuck assemblies under tension.

The wire transfer mechanism 550 is then clamped onto the drum assembly 504 by clamps 584. The pivoting vacuum chuck assembly 580 is activated causing the crosswires 46 to become adhered to the vacuum chuck 582. A cutter (not shown) is then used to cut the crosswires 46 from the drum assembly 504 to form a crosswire segment. At this point, the crosswires 46 are being held by the wire transfer mechanism 550. As the wire transfer mechanism 550 is then unclamped and removed from the drum assembly 504, the spacer 572 is removed from the wire transfer mechanism 550 causing the compression springs 570 to expand, thus holding the crosswires 46 in tension. This tension allows the crosswires 46 to maintain proper uniform spacing. The wire transfer mechanism 550 is then moved to a mask frame assembly as described with respect to previous embodiments where the crosswires 46 can be transferred to the mask frame as described with respect to previous embodiments.

As the embodiments that incorporate the teachings of the present invention have been shown and described in detail, those skilled in the art can readily devise many other varied embodiments that still incorporate these teachings without departing from the spirit of the invention.

What is claimed is:

1. An apparatus for applying crosswires to a tension mask frame assembly comprising:

(a) a drum assembly having one or more crosswires wrapped about a drum; and (b) a crosswire transfer device for simultaneously removing a plurality of crosswire segments from the drum and positioning the crosswire segments onto a mask frame assembly.

2. The apparatus of claim 1, wherein the crosswire transfer device comprises a set of transfer bars.

3. The apparatus of claim 1, wherein the crosswire transfer device is a contoured magnetic vacuum device.

4. The apparatus of claim 1, wherein the crosswire transfer device is a spring loaded wire transfer device.

5. A method of applying crosswires to a tensioned mask comprising:

(a) winding at least one crosswire around a cylindrical drum;

(b) cutting at least one crosswire to form crosswire segments having specified length;

(c) transferring the crosswire segments to a mask frame assembly; and (d) affixing the crosswire segments to a mask frame assembly.

6. The method as described in claim 5, further comprising the step of tensioning the crosswire segments when the crosswire segments are affixed to the tension mask frame.

7. The method as described in claim 6, further comprising the step of tensioning the crosswire segments with transfer bars.

8. The method as described in claim 7, further comprising the step of rotating the mask frame assembly around the cylindrical drum.

9. The method as described in claim 5, further comprising the step of attaching a spring-loaded wire transfer device to the cylindrical drum and the crosswires.

10. The method of claim 5, further comprising the step of clamping the crosswires to the spring loaded wire transfer device.

11. The method as described in claim 5, further comprising the step of removing the crosswires from the cylindrical drum with a magnetic vacuum device.

12. The method as described in claim 5, further comprising the step of attaching a set of transfer bars to the crosswires while the crosswires are still attached to the cylindrical drum.

* * * * *